US011097874B2

(12) United States Patent
Beijl et al.

(10) Patent No.: US 11,097,874 B2
(45) Date of Patent: Aug. 24, 2021

(54) POURING AID DEVICE AND METHOD FOR POURING

(71) Applicant: Vacu Vin Innovations Ltd., Queensway (GI)

(72) Inventors: Vanessa Beijl, Rotterdam (NL); Rui Medeiros Santos, Rotterdam (NL); Gerardus Adrianus Maria de Groot, Harmelen (NL)

(73) Assignee: Vacu Vin Innovations Ltd., Queensway (GI)

( * ) Notice: Subject to any disclaimer, the term of this patent is extended or adjusted under 35 U.S.C. 154(b) by 0 days.

(21) Appl. No.: 16/478,462

(22) PCT Filed: Jan. 16, 2018

(86) PCT No.: PCT/EP2018/051027

§ 371 (c)(1),
(2) Date: Jul. 16, 2019

(87) PCT Pub. No.: WO2018/130724

PCT Pub. Date: Jul. 19, 2018

(65) Prior Publication Data

US 2019/0389633 A1 Dec. 26, 2019

(30) Foreign Application Priority Data

Jan. 16, 2017 (NL) ..... 2018177

(51) Int. Cl.

| | |
|---|---|
| ***B65D 47/06*** | (2006.01) |
| ***B65D 47/32*** | (2006.01) |
| ***B65D 25/48*** | (2006.01) |

(52) U.S. Cl.
CPC ..... *B65D 47/066* (2013.01); *B65D 25/48* (2013.01); *B65D 47/32* (2013.01)

(58) Field of Classification Search
CPC ..... B65D 47/066; B65D 25/48; B65D 47/32; B65D 2205/00
See application file for complete search history.

(56) References Cited

U.S. PATENT DOCUMENTS

| | | | | |
|---|---|---|---|---|
| 3,834,594 | A * | 9/1974 | Schiemann | B65D 25/40 222/479 |
| 5,273,172 | A | 12/1993 | Rossbach et al. | |
| 2015/0096644 | A1* | 4/2015 | Lee | B65D 47/066 141/1 |

FOREIGN PATENT DOCUMENTS

| | | | |
|---|---|---|---|
| EP | 0 532 958 | A1 | 3/1993 |
| EP | 0 826 607 | A1 | 3/1998 |
| FR | 2 660 630 | A1 | 10/1991 |
| JP | 2004-359341 | A | 12/2004 |

* cited by examiner

*Primary Examiner* — Jason K Niesz
(74) *Attorney, Agent, or Firm* — Kilpatrick Townsend & Stockton LLP

(57) ABSTRACT

Pouring aid device for pouring a liquid, for example wine, from a container such as a bottle into a recipient such as a glass including
a neck part which is configured to fit on an opening of the container, for example on a bottle neck;
a pouring tube in fluid connection with a liquid channel of said neck part;
an air tube in fluid connection with an air channel of said neck part, arranged to extend into the container for letting air into and out of the container.

19 Claims, 7 Drawing Sheets

POURING AID DEVICE AND METHOD FOR POURING

This application is the National Phase of International Application No. PCT/EP2018/051027, filed Jan. 16, 2018, which claims priority to the Netherlands Patent Application No. 2018177, filed Jan. 16, 2017, the disclosures of which are incorporated by reference herein.

The invention relates to a pouring aid device for pouring a liquid, for example wine, from a container such as a bottle into a recipient such as a glass.

Such a device is commonly used to serve wine from a bottle into a glass by tilting the bottle and allows a better control of the flow of liquid such as wine trying to avoid for example spilling or trying to induce swirling of the liquid as to aerate the liquid while pouring. A pouring aid device generally includes a neck part which is configured to fit on an opening of the container, for example on a bottle neck and a pouring tube in fluid connection with said neck part. The pouring aid device may be closable, or may have to be replaced by a stopper to close off the container when not in use.

For some types of liquid, such as for example for old and/or delicate wines, swirling of the wine is not desired as this may deteriorate the quality of the wine. Existing devices however do not allow sufficient control on the flow of wine from the bottle into the glass, as prior art devices may still provoke or are even intended to induce gurgling of the liquid and/or allow a relatively long contact of the wine with ambient air and oxygen in between the bottle and the glass, which may deteriorate the quality of the delicate and/or old wine.

It is an aim of the present invention to solve or alleviate one or more of the above-mentioned problems. Particularly, the invention aims at providing a more efficient pouring aid device providing an improved control of the flow of liquid into a recipient, minimizing contact between the liquid and the air during pouring of the liquid into the recipient.

To this aim, there is provided a pouring aid device characterized by the features of claim 1. In particular, the pouring aid device for pouring a liquid, for example wine, from a container such as a bottle into a recipient such as a glass includes a neck part which is configured to fit on an opening of the container, for example on a bottle neck, a pouring tube in fluid connection with a liquid channel of said neck part, and an air tube in fluid connection with an air channel of said neck part, arranged to extend into the container for letting air into and out of the container. The air tube is configured to reach a bottom corner of the container such that in use during pouring, the air tube extends into an air bell formed in the bottom corner of the container. As the container is tilted during pouring, typically an air bell is formed in the bottom corner of the container oriented most upwardly. The air tube preferably reaches in this air bell to allow air to enter the container during pouring directly into the air bell, without bubbling through the liquid in the container. In this way, the air entering the container, such as a bottle, via the air tube and the air channel during pouring of the liquid does not come into contact with the liquid, for example wine, as the air can be led directly to the air bell forming in the bottom corner of the container during pouring of the liquid. The air bell can form in the bottom corner of the container which is turned upwards during pouring of the liquid. The air tube can have a length of for example 15-20 cm or smaller or larger according to the size of the container. An angle between an exit opening of the pouring tube and a centre line of the neck part is comprised in a range of 130°-140°, and is preferably around 135°. Said angle allows a relatively comfortable hold of the container and a relatively low flow rate, while, preferably, the pouring tube may reach approximately until a bottom of a recipient. Increasing the angle would lead to a higher flow rate risking that the liquid may arrive in the recipient in a relatively turbulent way.

Decreasing the angle might result in a relatively slow flow rate, which might become relatively uncomfortable for the person holding the container in a tilted pouring position. The pouring aid device can also be arranged to prevent said angle from increasing beyond for example 140°, for example by defining a stop member. The air channel of the neck part is separate from the liquid channel to prevent the liquid being poured out of the container during use from coming into contact with air entering the container. So, contrary to prior art devices, liquid can be poured out of the container while not coming into contact with air entering the container. This is in particular advantageous for old and/or delicate wine for which contact with air/oxygen may deteriorate the quality of the wine.

By separating the air channel from the liquid channel in the neck part of the pouring aid device, air can still get into the container, for example into the bottle, to obtain a fluent flow of the liquid during pouring of the liquid, without contacting the flow of liquid exiting the container through the pouring tube. This is especially advantageous in case of pouring a delicate or old wine from a bottle into a glass, for which prior art pouring aid devices cannot sufficiently avoid contact with air entering the bottle during pouring.

The neck part can preferably be configured to receive the air tube under an angle of at least 5°, preferably at least 7°, with respect to a centre line of the neck part. With such an inclined position of the air tube with respect to the neck part, the air tube may more reliable reach the air bell present in a bottom corner of the container during pouring. Advantageously, the air tube is approximately straight, which, even with an inclined position, allows relatively easy insertion into the container via a container neck, such as a wine bottle neck. The air tube can thus more easily reach the air bell forming in the bottom corner of the container during pouring of the liquid without being curved, improving the flow of air and simplifying the construction of the air tube.

More preferably, the air tube can be removably connectable with the neck part, which makes cleaning and/or rinsing of the air tube easier. Alternatively, the air tube can also be fixedly connected to the neck part of the pouring aid device.

Advantageously, a ratio of a diameter of the pouring tube to a diameter of the air tube can be such that a liquid flow rate is under 15 ml per seconds, preferably under 13 ml per seconds. The slower the liquid flow rate, the better it is for some delicate liquids such as old wine in order to avoid the liquid arriving in a recipient such as glass relatively violently. For the person holding the container in a pouring position, it may however become relatively difficult to continue holding the container in this position. A flow rate under 15 ml per seconds, preferably under 13 ml per seconds, for example of 12.5 ml per seconds, allows filling a glass of for example 150 ml within 12 seconds, which is an acceptable compromise between relatively delicate pouring of liquid and an endurable pouring time during which the container must be held in a pouring position by a user. In order to arrive at such a flow rate, it has been shown that it is advantageous to adjust the ratio of a diameter of the pouring tube to a diameter of the air tube, to for example a ratio of 5:3, rather than for example adjusting a pouring position of the container, such that the pouring position can be kept relatively stable during pouring.

A length of the pouring tube can for example be at least 5 cm, preferably at least 7 cm, for example around 12 cm. Such a length generally corresponds to a typical depth of a recipient, such as a glass, for example a wine glass, and allows the pouring tube to reach a bottom of that recipient. By reaching the bottom of the glass, it can be avoided that the liquid, for example wine, comes into contact with the ambient air, in particular with oxygen, before reaching the glass. During pouring, the pouring tube is held a small distance, preferably as close as possible, above the bottom of the recipient to allow liquid to exit the pouring tube. Once the recipient is starting to fill with liquid, the pouring tube is held at the same initial position such that there is minimal contact between the poured liquid and environmental air. The liquid can thus arrive in a bottom area of the recipient and be pushed up during pouring of more liquid while the pouring tube remains in place as it reaches a bottom of the recipient. This is contrary to the way of pouring liquid and filling a container, especially a wine glass, with a conventional pouring aid device, with which liquid such as wine is being poured into a recipient from a position considerably above the liquid, the liquid being added to a top level of the liquid in the container.

The neck part can advantageously at least partly be made of a resilient material. In this way, the neck part can be clamped on a container, for example into a bottle neck of a wine bottle. The resilient material can for example also provide a sealing closure between the neck part and the container. The person skilled in the art will readily understand that the neck part can be formed in many different ways and/or from many materials.

In a particular embodiment the neck part may comprise a lower part having a liquid inlet opening of a liquid channel, an upper part having an outlet opening of the liquid channel and a bridging part between the lower part and upper part defining part of the liquid channel. Preferably the lower part, upper part and bridging part are one piece. Also preferably the lower part, upper part and bridging part are at least substantially made out of silicon. Particularly the lower part, upper part and bridging part may be formed by molding. The lower part of the neck part can be configured to fit on an opening of the container, for example in a bottle neck. The upper part of the neck part can be used to hold the neck part while positioning the lower part in the bottle neck. The upper part may be configured for coupling of the pouring tube thereto. The bridging part may be flexible or deformable in order to allow for a desired positioning of the upper and lower parts of the neck part with respect to each other. The lower part preferably has sealing means which are adapted to engage with an inner surface of the bottle neck 6 to allow a reliable fit of the neck part in the bottle neck.

Preferably, the pouring tube can form a single piece with the neck part. This can avoid irregularities in the transition between the liquid channel in the neck part and the pouring channel, and enhance the flow of liquid out of the container.

In an advantageous embodiment, the pouring aid device can be adjustable between at least an open position in which liquid can exit the container through the pouring tube, and a storage position in which the pouring tube is closed off. When the container is not emptied at once, the liquid may need to be stored while avoiding air contact, especially contact with oxygen, as much as possible. Therefore, the pouring tube may be closed off in a storage position, for example by a valve within the pouring tube, or with a stopper to be put on an end of the pouring tube, or by folding the pouring tube, or by any other means known to the person skilled in the art.

The pouring tube can advantageously at least partly be made of a flexible material such that the pouring tube includes at least one flexible area. Such a flexible area allows the pouring tube to be squeezed, bended and/or folded at the flexible area, which can close off the pouring tube, even without the need for an additional closing element. There may for example be a pre-defined folding line along which the pouring tube can be folded, but this is preferably not the case. The pouring tube may be entirely made of a flexible material, or only comprise at least one flexible area. The flexible area can provide sufficient flexibility to allow squeezing of the pouring tube, but at the same time, the material of the pouring tube is chosen to be sufficiently rigid to keep the pouring tube open when not exposed to, for example, squeezing.

The pouring aid device can preferably comprise a closing element configured to close off the pouring tube. The closing element may for example be a valve within the pouring tube or, more preferably, be a closing element arranged outside the pouring tube, such as a stopper or any other suitable closing means.

More preferably, said closing element may be configured to close off the pouring tube by squeezing the pouring tube in the at least one flexible area. The at least one flexible area of the pouring tube, or substantially the entire pouring tube, may be configured such that walls of the pouring tube can be moved towards each other to close off the pouring tube, for example by a closing element pressing against an outside of the pouring tube squeezing the pouring tube.

The pouring tube may preferably also be arranged to be folded substantially along or around the neck part to a storing position of the pouring aid device. The folding of the pouring tube may in itself be sufficient to close off the pouring tube, or may only cause a bend in the pouring tube without entirely closing off the pouring tube. This folding of the pouring tube can simultaneously provide a relatively compact way for storing the container with the pouring aid device, as well as provide a relatively easy and efficient way of closing off the pouring tube. In an open position of the pouring aid device, the pouring tube can for example extend away from the neck part. Alternatively, the pouring tube may also remain in the same position both in the open as in the storage position of the pouring aid device, for example when the closing of the pouring tube is obtained with a stopper. So, the open position is in fact a pouring position. The storage position is in fact a closed position. In the closed position, the pouring tube is closed off, while the actual position, i.e. orientation, of the pouring tube can be the same in the open and the closed position, the tube is then simply closed off. Alternatively, in the closed position, the actual position, i.e. orientation, of the pouring tube can be adjusted with respect to the orientation in the pouring position. For example, in the pouring position, the pouring tube can extend substantially away from the neck part and in the storage position, the pouring tube can extend substantially along the neck part. Many variants are possible.

Advantageously, in the folded state of the pouring tube, i.e. in the storage position in which the pouring tube extends substantially along the neck part, not only the pouring tube is closed off by e.g. a closing element, but, additionally, the air channel in the neck part is closed off as well. This is in particular advantageous, as then, during storage, no additional air can enter the air tube and come into contact with the liquid in the container. So, a better conservation of the wine, during storage, may be obtained.

In a preferred embodiment of the invention, the pouring aid device can further comprise a housing including a first housing part arranged to substantially enclose part of the neck part. The housing may particularly comprise two coupled shell parts defining a space there between for receiving the part of the neck part therein. More particularly, between the shell parts and the part of the neck part an air chamber may be formed into which the air tube opens at one open end thereof. As such the air tube may draw air from the air chamber to enter the container during pouring. Preferably the air chamber is in open fluid communication with an outside air so that fresh air can be continuously fed into the air chamber. In a further preferred embodiment the two shell parts are substantially form-retaining, and preferably are made of metal. As such the shells are particularly suited to prevent deformation of more flexible or deformable parts of the pouring aid device held in the space between the shells.

The housing may comprise a second housing part substantially enclosing the pouring tube. The housing can protect the neck part and/or the pouring tube, in particular when at least part of the neck part and/or pouring tube are made of a flexible material. The housing can also provide additional solidity to the pouring tube and/or the neck part of the pouring aid device.

Advantageously, said first housing part can be pivotably attached to said second housing part, providing a relatively solid attachment of the pouring tube. More preferably, said second housing part can form a handle to move the pouring tube between an open position and a storing position of the pouring aid device, providing a relatively solid but simple way of bringing the pouring aid device into an open and/or into a storage position.

Most advantageously, said second housing part can include the closing element, which is configured to press against an outside of the pouring tube for closing off said pouring tube in a storage position of the pouring aid device. Pressure of the closing element against the pouring tube can for example be obtained by moving or sliding the closing element inwardly towards the pouring tube. Or, more preferably, the closing element may be arranged such that an end of the closing element pressingly engages an outside of the pouring tube when folding or bending the pouring tube substantially along the neck part of the pouring aid device, closing off the pouring tube by squeezing the tube. In this way, air is prevented from entering the pouring tube in the closed position of the pouring aid device.

Said closing element is configured to close off the air tube in a storage position of the pouring aid device, for example by squeezing, in a similar manner as the closing off of the pouring tube. For example, the pouring tube may be squeezed, preferably in an at least partly flexible area, to be closed off, by folding. Due to the folding of the pouring tube, the pouring tube may move somewhat sideways resulting in closing off of the adjacent air channel in the neck part of the device. As such, the air channel and the pouring tube are simultaneously closed off to prevent air from entering the air channel and pouring tube. In this way, liquid in the container, for example wine in a bottle, can be efficiently cut off from air, in particular from oxygen in the storage position of the pouring aid device. Additional exchanging of the pouring aid device for a stopper during temporary storage of the liquid may thus be avoided in between two pouring handlings of liquid.

A second aspect of the invention provides a method for pouring liquid from a container into a recipient as defined by the features of claims 16-19. Said method can provide one or more of the above-mentioned advantages.

The present invention will be further elucidated with reference to figures of exemplary embodiments. Corresponding elements are designated with corresponding reference signs.

Figure 7A:
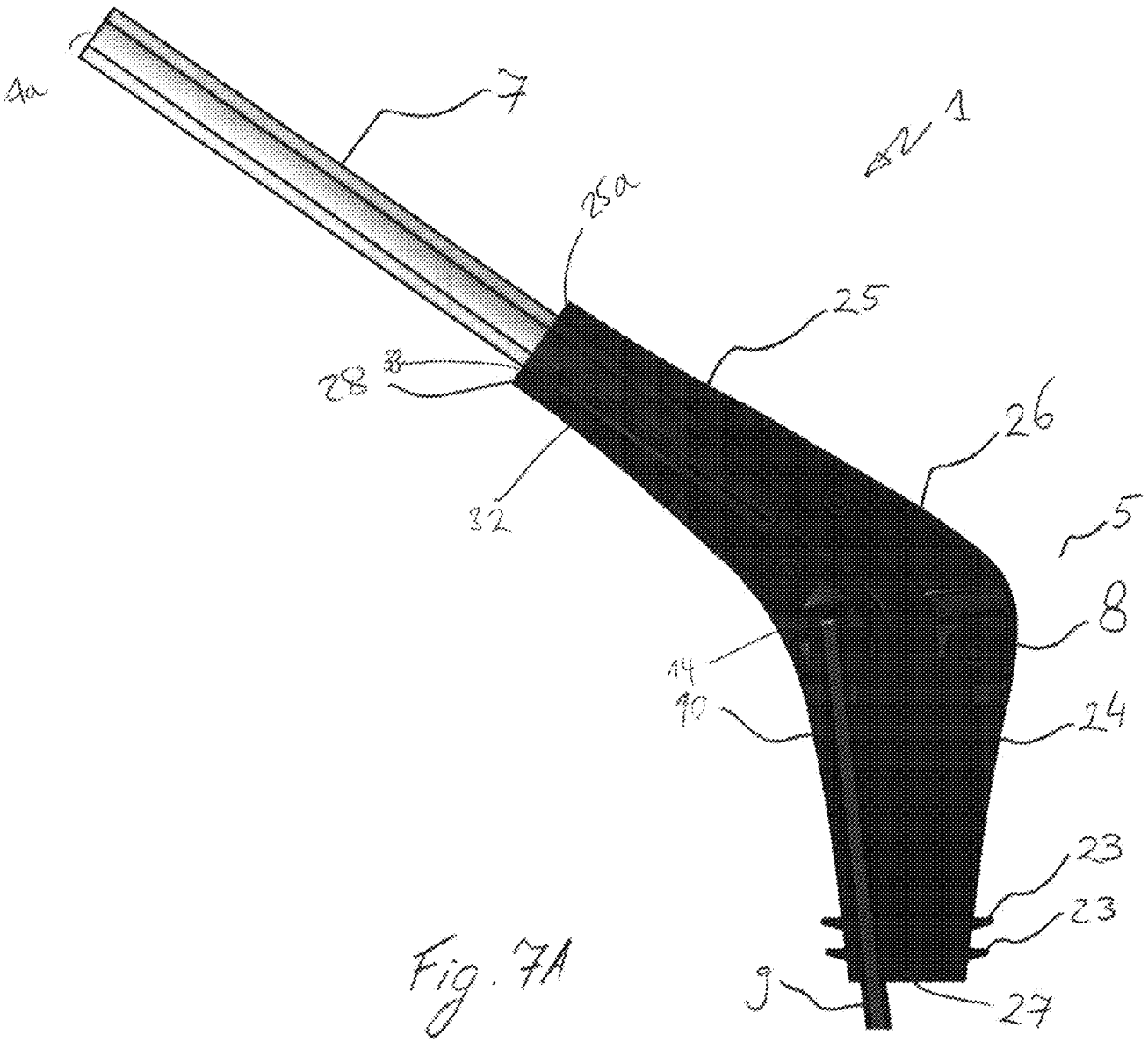
Figure 7B:
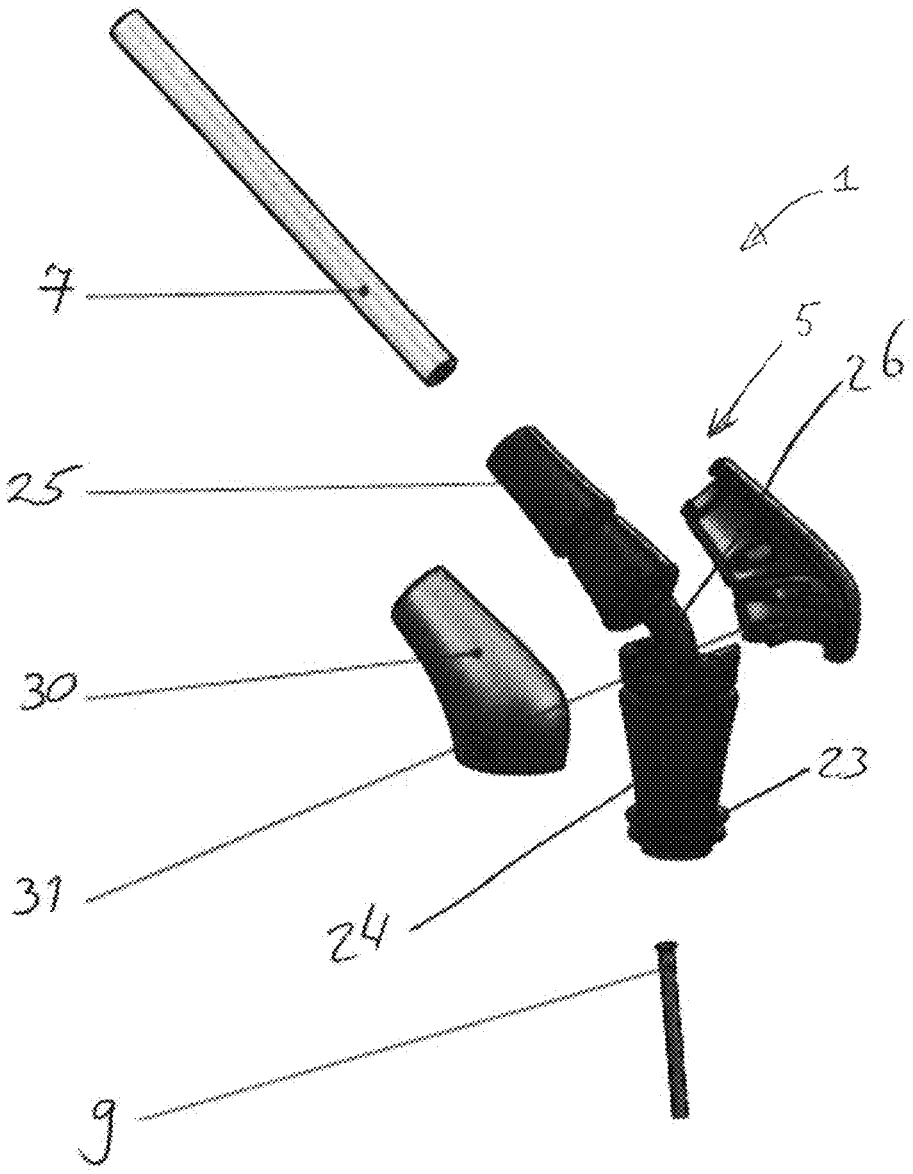

FIG. 7A-B shows a schematic cross section respectively an exploded view of a third embodiment of a pouring aid device according to the invention.

Figure 1:
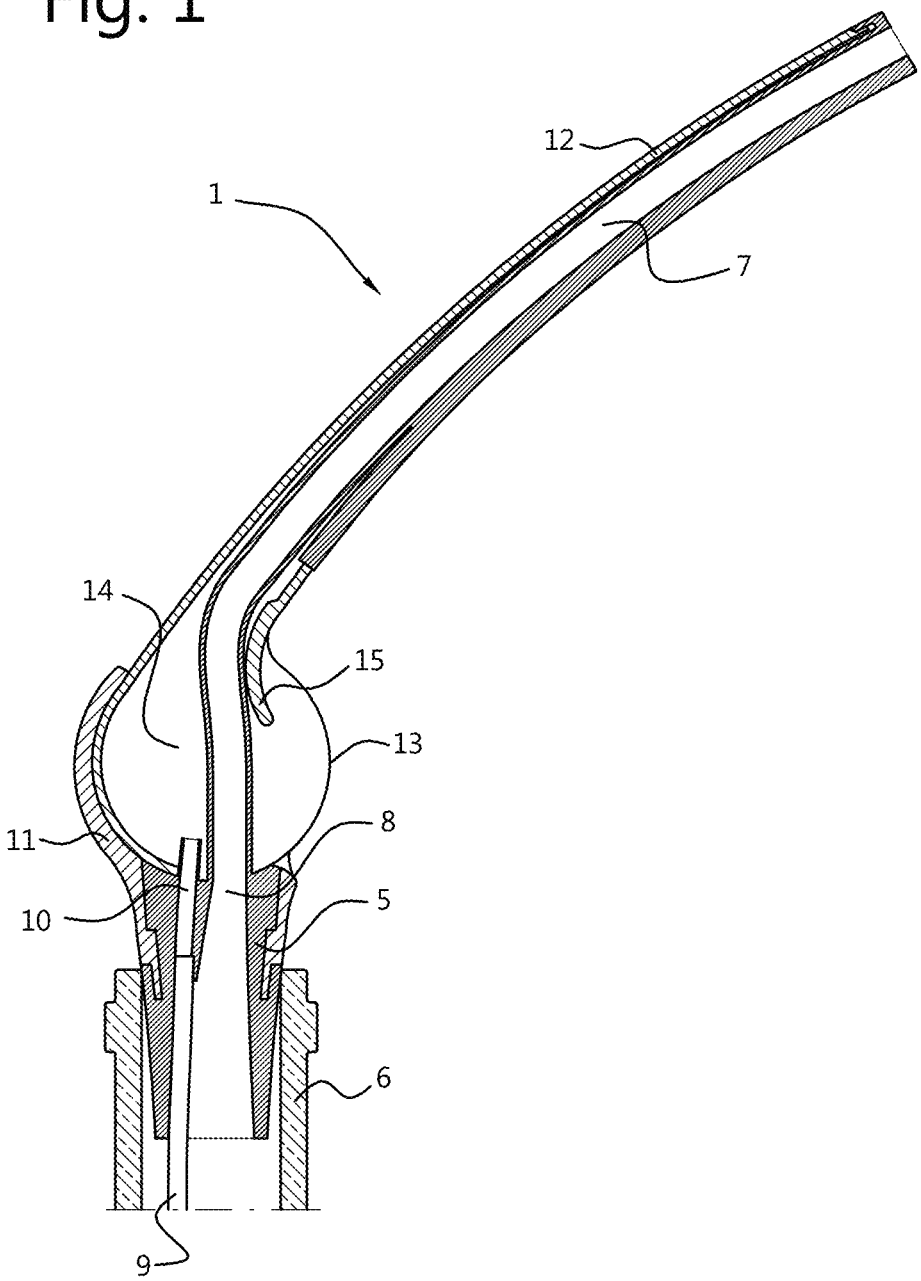
FIG. 1 shows a schematic cross section of a preferred embodiment of a pouring aid device according to the invention with the pouring tube in an open position.

FIG. 1 shows a schematic cross section of a preferred embodiment of a pouring aid device according to the invention on a container with the pouring tube in an open position. The pouring aid device 1 for pouring a liquid 2, for example wine, from a container 3 such as a bottle into a recipient 4 such as a glass includes a neck part 5 which is configured to fit on an opening of the container 3, for example on a bottle neck. The neck part 5 can for example have an inverted frusto-conical shape so that the neck part 5 can be inserted and clamped into a bottle neck 6 of a container 3. The neck part 5 can also at least partly, or substantially entirely, be made of a resilient material, such as for example of cork, or rubber, or any other suitable material, or of a combination of materials. The pouring aid device 1 also comprises a pouring tube 7 in fluid connection with a liquid channel 8 of said neck part 5. The pouring tube 7 may, but need not, form a single piece with the neck part 5. In an open position of the pouring aid device 1, as illustrated in FIG. 1, the pouring tube 7 may extend away from the neck part 5 of the pouring aid device 1. The pouring aid device 1 further comprises an air tube 9 in fluid connection with an air channel 10 of said neck part 5. The air tube 9 is arranged to extend into the container 3 for letting air into and out of the container 3. The air channel 10 of the neck part 5 is separate from the liquid channel 8 to prevent the liquid 2 being poured out of the container 3 during use from coming into contact with air entering the container 3. In this preferred embodiment, the pouring aid device 1 further comprises a housing including a first housing part 11 arranged to substantially enclose part of the neck part 5, and a second housing part 12 substantially enclosing the pouring tube 7. The first housing part 11 can for example be a die cast housing part, whereas the second housing part 12 may for example be made of a plastic, such as for example PP, PA, POM, ABS or any other suitable material known to the person skilled in the art. The second housing part 12 may be slightly curved, preventing the need for excessive tilting of the container during pouring, and simultaneously improving liquid flow during pouring The first housing part 11 can be pivotably attached to said second housing part 12. Therefore, the second housing part 12 can include a substantially cylindrical or spherical or rounded end 13, around which the first housing part 11 can pivot. The end 13 can include a cavity 14 through which the pouring tube 7 can extend, and/or into which the air channel 10 of the neck part 5 may extend. The first housing part 11 may only partly cover the neck part 5 such that resilient material of the neck part 5 can engage a clamping contact with an inside of a bottle neck 6. The second housing part 12 may substantially fully enclose the pouring tube 7, or may only cover one side of said pouring tube 7, for example the side turned upwardly as illustrated in FIG. 1, which may be advantageous as the second housing part 12 can form a handle to move the pouring tube 7 between an open position (FIG. 1) and a storing position (FIGS. 2 and 3) of the pouring aid device 1. Additionally, a second housing part 12 only partially covering the pouring tube 7 may be advantageous for the manufacturability and/or simplify disassembly of the pouring aid device, for example for cleaning and/or servicing.

Figure 2:
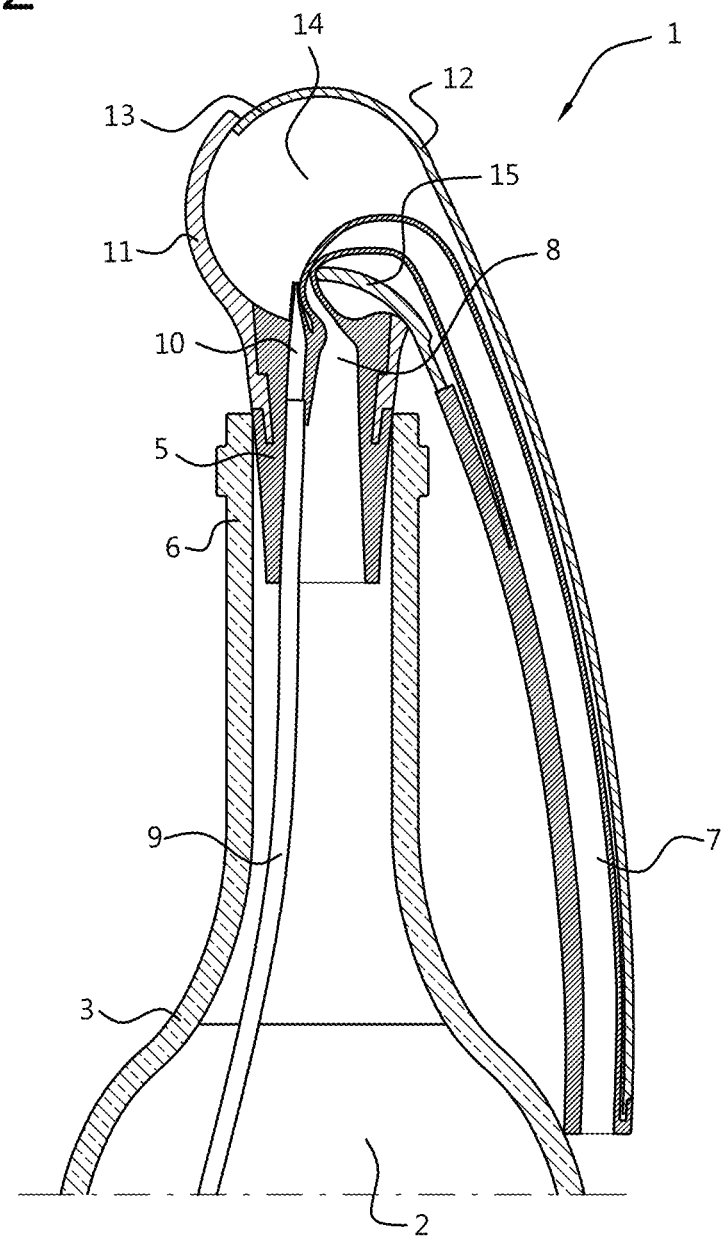
FIG. 2 shows a schematic cross section of the pouring aid device of FIG. 1 with the pouring tube in a closed position.

FIG. 2 shows a schematic cross section of the pouring aid device of FIG. 1 with the pouring tube 7 in a closed position. The pouring aid device is adjustable between at least an open position (FIG. 1) in which liquid 2 can exit the container 3 through the pouring tube 7, and a storage position in which the pouring tube 7 is closed off (FIGS. 2-3), in which position the pouring tube 7 is arranged to be folded substantially along the neck part 5 and/or along the bottle neck 6 of the container 3. Thereto, the pouring tube 7 can at least partly be made of a flexible material such that the pouring tube 7 includes at least one flexible area. In the embodiment of FIG. 2, the pouring tube is substantially entirely made of a flexible material, such as for example food contact grade rubber, as for instance silicone, and is made in one piece with the neck part 5 of the pouring aid device 1. The pouring aid device 1 of FIG. 2 comprises a closing element 15 configured to close off the pouring tube 7. Said closing element 15 is arranged outside the pouring tube 7 and is configured to close off the pouring tube 7 by squeezing the pouring tube 7 in the at least one flexible area. In this very advantageous embodiment, said second housing part 12 includes the closing element 15, which is configured to press against an outside of the pouring tube 7 for closing off said pouring tube 7 in a storage position of the pouring aid device 1. The closing element 15 is formed by an underside, i.e. turned towards the container 3, of the second housing part 12 extending into the cavity 14. The extending closing element 15 is long enough so as to press against the pouring tube 7 in a closed position of the pouring aid device 1 causing a fold in the pouring tube 7 such that the pouring tube 7 is closed off by squeezing the walls of the pouring tube 7 against each other. An end of the closing element 15, which extends into the cavity 14 can be slightly curved to allow a straight passage of the pouring tube 7 in the open position of the pouring aide device 1. The closing element 15 can also be configured to close off the air channel 10 in a storage position of the pouring aid device 1. In the embodiment of the FIGS. 1-3, the closing element 15 is long enough to squeeze the pouring tube 7 and to push said squeezed pouring tube 7 against an end of the air channel 10 slightly extending into the cavity 14 such that the squeezed pouring tube 7 closes off the end of the air channel 10 extending into the cavity 14.

Figure 3:
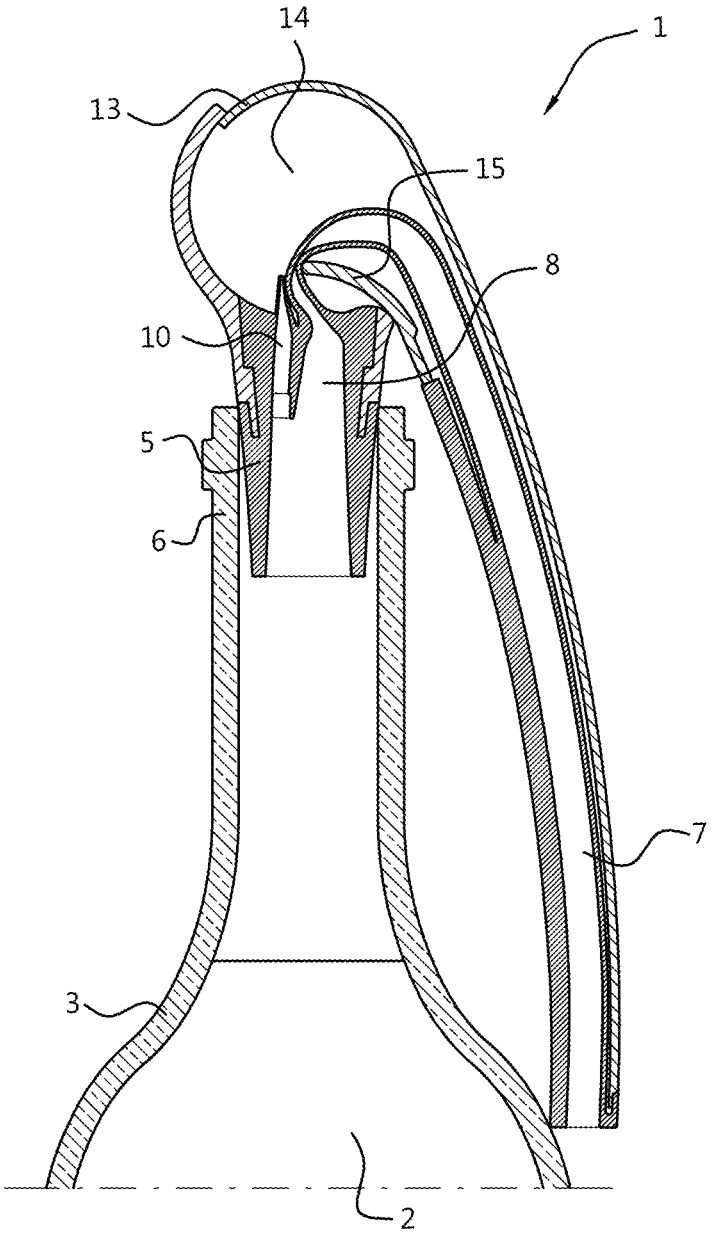
FIG. 3 shows a schematic cross section of the pouring aid device of FIG. 2 without the air tube.

FIG. 3 shows a schematic cross section of the pouring aid device of FIG. 2 without the air tube. The air tube 9 can be removably connectable with the neck part 5, in which case the air tube 9 can be easily taken off to be cleaned or rinsed. Alternatively, the air tube 9 could also be made in one piece with the neck part 5. Also without the air tube 9, the air channel 10 can be closed off in the same manner as described above. The first housing part 11 and the second housing part 13 are arranged in such a way that in the closed position of the pouring aid device 1, the first housing part 11 still slightly engages the second housing part 12 such that there is no gap into the cavity 14. The rounded end of the second housing part 12 does however not provide more overlap with the first housing part 11, so that in an open position of the pouring aid device 1, when an outer side of the second housing part 12 slidingly engages an inner side of the first housing part 11, the rounded end of the second housing part 12 abuts on an external wall of the air channel 10 extending into the cavity 14. This abutment can also provide a stop so that the pouring tube 7 can be prevented from being turned further than the ideal pouring position, as illustrated in FIG. 4 and as will be explained further on with FIGS. 5-6.

Figure 4:
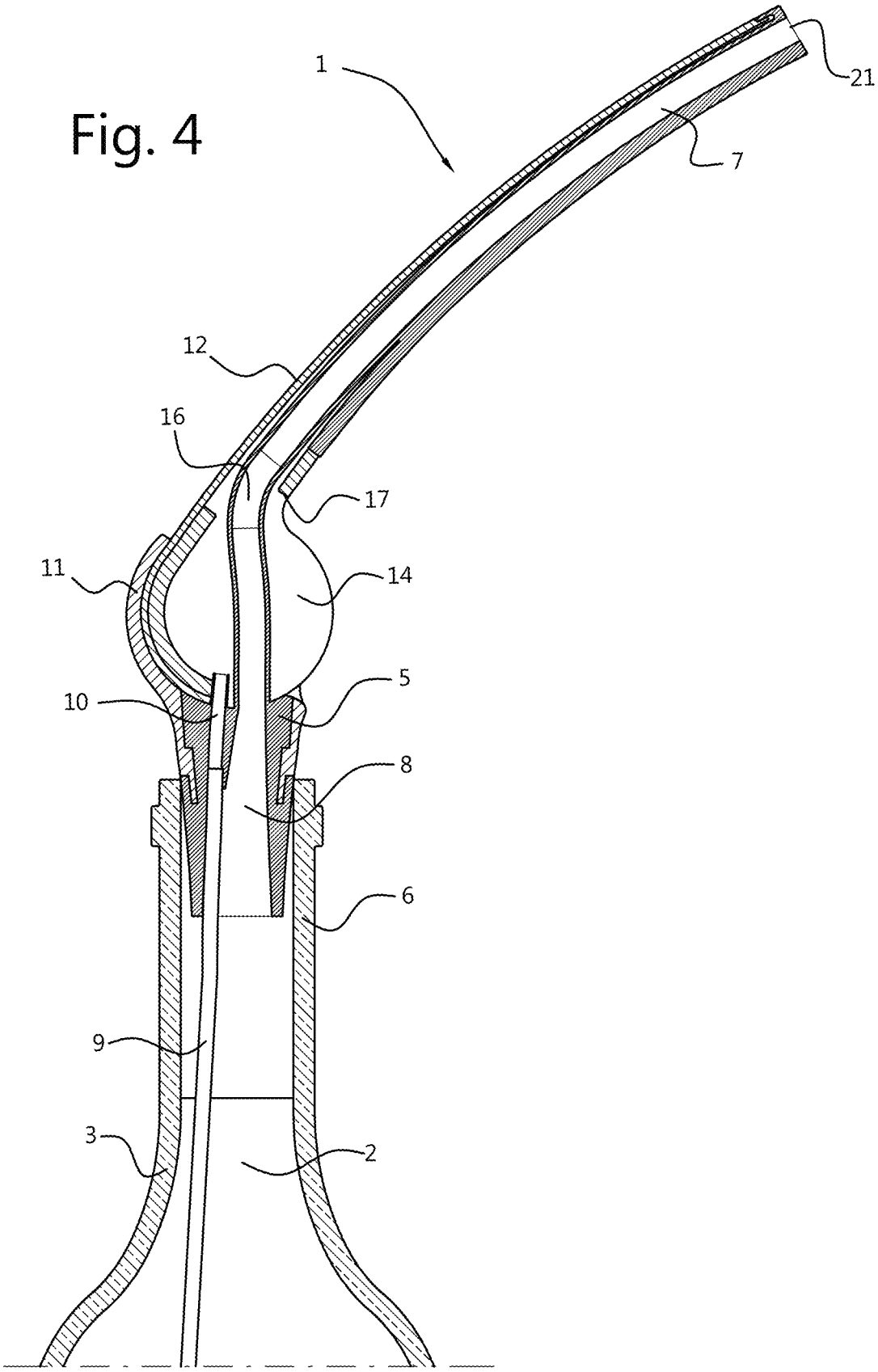
FIG. 4 shows a schematic cross section of a second embodiment of a pouring aid device according to the invention.
Figure 5:
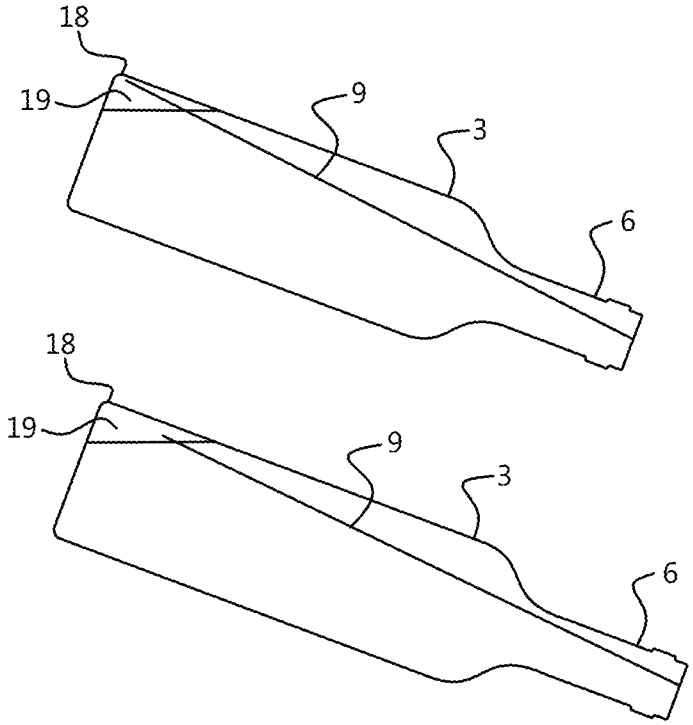
FIG. 5 shows a schematic cross section of a first and a second container in a pouring use position.

FIG. 4 shows a schematic cross section of a second embodiment of a pouring aid device 1 according to the invention. Most elements discussed with respect to FIGS. 1-3 also apply to the embodiment of FIG. 4. For example, as can be more clearly seen in this FIG. 4, the second housing part 12 can be made not to enclose the pouring tube 7 tightly so that air can leak into the cavity 14 along the pouring tube 7 during pouring of the liquid 2. Also the neck part 5 can be configured to receive the air tube 9 under an angle of at least 5°, preferably at least 7°, with respect to a centre line of the neck part 5. Said angle may however be limited by the width of the bottle neck 6. As can be seen in FIG. 5, showing a schematic cross section of a first and a second container 3, in particular a first and second bottle, in a pouring use position, the air tube 9 is configured to reach a bottom corner 18 of the container 3, i.e. bottle, such that in use during pouring, the air tube 9 extends into an air bell 19 formed in the bottom corner 18 of the container 3. A length of the air tube 9 can for example lie in a range of 15-20 cm, for example be more or less 18 cm, such that a same air tube 9 can be used on different sizes of bottles while the air tube 9 can still reach the air bell 19 forming in the bottom corner 18 of the bottle 3 in a pouring position. In the embodiment of FIG. 4, the pouring tube 7 comprises a flexible area 16 where the pouring tube 7 leaves the cavity 14 and makes a bend into the second housing part 12. The flexible area 16 can be squeezed by the edge 17 of the second housing part 12 opening up into the cavity 14, even without a separate closing element 15 as is present in the first embodiment of the FIGS. 1-3. The result, i.e. closing off the pouring tube 7 and/or the air channel 10, is the same.

Figure 6:
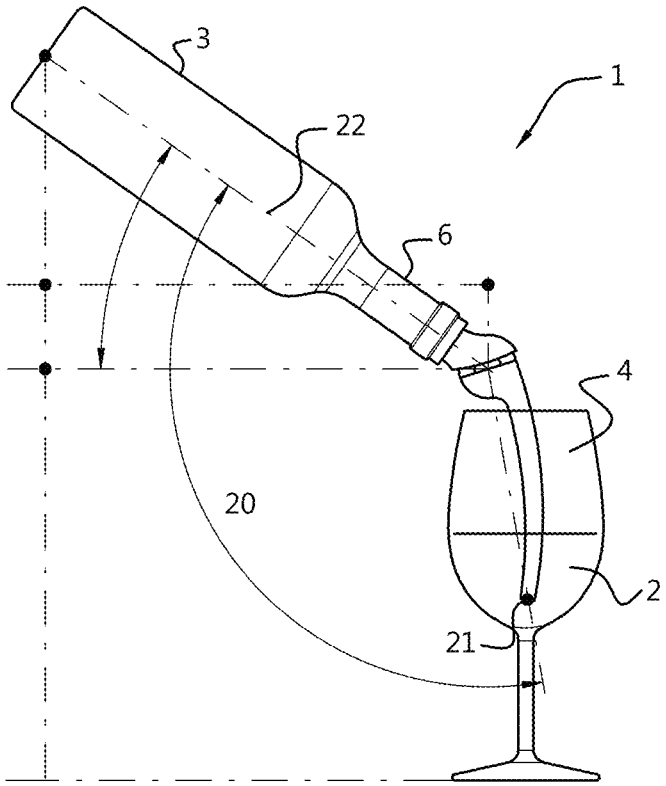
FIG. 6 shows a schematic side view of a pouring aid device according to the invention on a container in a pouring position.

FIG. 6 shows a schematic side view of a pouring aid device 1 according to the invention in a pouring position. In particular, the bottle 3 is tilted, and can be held in this pouring position by for example a waiter. Liquid 2, for example wine, can be poured from the bottle 3 into a recipient 4 such as a wine glass. It has been shown experimentally that a liquid flow rate is preferred under 15 ml per seconds, preferably under 13 ml per seconds, for example a flow rate of 12.5 ml per seconds so that a standard wine glass of 150 ml can be filled within 12 seconds. The value of this flow rate takes into account the effort of the waiter to be made to hold the bottle 3 in a tilted pouring position (FIGS. 5-6), which may become uncomfortable if this takes too long, as well as the smooth flow of the liquid 2 arriving in the recipient 4, such as the glass. A higher flow rate might cause a relatively turbulent flow of liquid 2 into the recipient 4, which may negatively influence the quality of for example delicate old wine. It has also been shown that in the open position of the pouring aid device 1, an advantageous angle 20 between an exit opening 21 of the pouring tube 7 and a centre line 22 of the neck part 5 and/or of the container 3 is comprised in a range of 130°-140°, and is preferably around 135°, providing the same advantages as mentioned just above. Another element, apart from the advantageous angle 20, contributing to the desired flow rate, is a ratio of a diameter of the pouring tube 7 to a diameter of the air tube 9 such that a liquid flow rate can be under 15 ml per seconds, preferably under 13 ml per seconds. Said ratio can for example be a ratio of more or less 1.67, with an internal diameter of for example more or less 5 mm for the pouring tube 7 and an internal diameter of the air tube 9 of for example more or less 3 mm. A length of the pouring tube 7 is preferably at least 5 cm, preferably at least 6 cm, for example in the range of 10-13 cm, corresponding to a typical depth of for example a wine glass, such that an exit opening 21 of the pouring tube 7 can be held near a bottom of the recipient 2. Such a length of a pouring tube 7 of a pouring aid device 1 allows an innovative method of pouring liquid 2, such as wine, into a recipient 4, for example a wine glass. In a first step, a pouring aid device 1, as described above, is fixed on a container 3, for example a bottle, which is filled with liquid 2, for example wine. Fixing can for example be done by inserting and clamping a neck piece 5 of the pouring aid device 1 in a bottle neck 6, or in any other way known to the person skilled in the art. The pouring aid device 1 can then be brought from a storage position, in which the pouring tube 7 is closed off, to an open position of the pouring tube 7 by pivoting the pouring tube 7 from the storage position substantially along a neck part 5 of the pouring aid device 1 to the open position, in which an exit opening 21 of the pouring tube 7 preferably makes an angle 20 with a centre line 22 of the neck part 5 comprised in a range of 130°-140°, and preferably around 135°. The container 3, e.g. bottle, can then be tilted into a pouring position, and a pouring tube 7 of the pouring aid device 1 can be inserted into a recipient 4, for example a glass, such that said pouring tube 7 reaches a bottom area of the recipient 4. The liquid 2 is then being poured into the recipient 4 while the pouring tube 7 is kept close to the bottom area of the recipient 4. Liquid is thus flowing upwardly from the bottom of the recipient while being poured into the recipient, which is in contradiction with the prior art pouring methods of for example wine, when the exit opening of a bottle or of a pouring aid device on a bottle is held above the liquid level in the recipient such that liquid is filled up from above. After filling the recipient 4, the pouring aid device 1 can be brought into a storage position again, in which the pouring aid device 1 is closed off, preferably by squeezing the pouring tube 7, by folding the pouring tube 7 substantially along a neck part 5 of the pouring aid device 1. In this way, thanks to the pouring aid device 1 according a preferred embodiment of the invention, for example old and delicate wine can be poured into a wine glass hardly without being exposed to oxygen, which may deteriorate the wine, and at the same time, may be stored in between two servings, also while avoiding oxygen contact, without having to exchange the pouring aid device 1 for a separate stopper.

FIGS. 7A and 7B shows a third embodiment of a pouring aid device 1 according to the invention. Features discussed with respect to FIGS. 1-4 may also apply to the embodiment of FIG. 7*a* and FIG. 7*b*. The embodiment of a pouring aid device 1 shown in FIG. 7*a* and FIG. 7*b* includes a neck part 5 which is configured to be fittingly received at least partially into a bottle neck 6 of a container 3, such as a wine bottle. The neck part 5 may comprise sealing means 23 adapted to engage with an inner surface of the bottle neck 6 to provide a fluid tight fit of the neck part 5 of the pouring aid device 1 in the bottle neck 6 of the container. The sealing means 23 may be provided on an outer surface of the neck part 5. The sealing means 23 may also be integral with the neck part 5, e.g. be made in one piece. The sealing means 23 may be partially or completely flexible, e.g. be of resilient material, to allow use of the pouring aid device 1 in different bottle necks varying in a size of opening of the bottle neck. The flexible sealing means 23 enable a fluid tight fit of the neck part 5 of the pouring aid device 1 in such different bottle necks. As shown in FIG. 7 the sealing means 23 may comprise one, two or more flexible sealing edges extending circumferentially from a lower part 24 of the neck part 5, which lower part in use will extent in the opening of the bottle neck. Two or more sealing edges may be provided, the sealing edges differing in size. Alternatively, two or more sealing edges may be provided having a same size. The one or more sealing edges are flexible so that they may plastically and/or elastically deform when the neck part 5 of the pouring aid device 1, having a diameter defined by the sealing edge larger than a diameter of an opening of a bottle neck of a container, is introduced in such opening. The sealing means 23 are adapted to provide a fluid tight fit of the neck part 5 of the pouring aid device 1 in a bottle neck 6 of a container such that an unexpected and/or undesired loosening and/or complete detachment of the pouring aid device 1 from the bottle neck of the container is prevented. The sealing means preferably are adapted to allow an intended removal of the neck part 5 out of the bottle neck 6, particularly by applying a sufficient pulling force on the pouring aid device 1.

The lower part 24 of the neck part 5 may generally have a core body with an outer shape resembling a frustum of a cone, e.g. the core body being frustoconically shaped, with the flexible sealing means 23 laterally extending from the core body, as can be seen e.g. in FIG. 7B. Such shaped core body enables in use an easy fit of the neck part 5 in an opening of a bottle neck. Attached to the lower part 24 of the neck part 5 is, in this embodiment, an upper part 25 of the neck part 5. The upper part 25 of the neck part 5 is intended to reside, in use, above the bottle neck 6 of the container in which at least part of the lower part 24 is fittingly received, to enable coupling of a pouring tube 7 of the pouring aid device 1 thereto. The upper part 25 in use extending above the bottle neck 6 provides an external surface which may be for example grabbed by a user to push the pouring aid device 1 into a bottle neck 6 respectively pull the pouring aid device 1 out of the bottle neck 6. Such grabbing of the upper part 25 is possible with or without the pouring tube 7 being coupled thereto. The pouring tube 7 may, but need not, form a single piece with the neck part 5. The pouring tube 7 may be detachable from, or be removably coupled to, the neck part 5. The pouring tube 7 may be received with a coupling part thereof in an space provided in the upper part 25 of the neck part 5 as illustrated in FIG. 7A. The space 32 opens at an outer end 25*a* of the upper part 25 with an opening through which the pouring tube 7 may extend. The space 32 in the upper part 25 may slightly narrow from the opening towards an inner of the upper part 25 to e.g. clampingly receive the coupling part of the pouring tube 7 when inserted in the space 32. Also, due to this narrowing of the space 32, there might be a limited, preferably capillary, space 33 between the pouring tube 7 and a wall of the space 32 when the pouring tube 7 is inserted into the space 32. Such small space 33 may function as a droplet catcher, to catch some droplets that are left on the pouring tube 7 after pouring. In a next pouring action, the droplets caught in the small space 33 can then move along the pouring tube 7 towards a pouring end 7*a* thereof to be poured along with other liquid into a recipient. The limited space 33 is very small and might be sufficient to catch a limited number of droplets, between about 3 to about 10 droplets.

Additionally, or alternatively, attachment means may be provided in the upper part 25 of the neck part 5 or in the pouring tube 7 for attachment of the pouring tube 7 to the neck part 5. For example a snap-fit may be used to attach the pouring tube 7 to the neck part 5. Preferably the pouring tube 7 is removably attached to the neck part 5, to the extent that the pouring tube may be detached from the neck part 5 without affecting an integrity of the pouring tube 7. Thus, for example, one pouring tube 7 coupled to the neck part 5 may be removed and exchanged for another pouring tube if desired. A separate closure means, such as a lid, may be provided to close the space of the upper part 25, particularly as a fluid tight seal, when the pouring tube 7 is detached from the neck part 5. The closure means may be adapted to fit on the outer end 25*a* of the upper part 25 having the opening. A pouring part of the pouring tube 7, at an end of the pouring tube 7 opposite the coupling part, may extend away from the neck part 5 of the pouring aid device 1. A length of the pouring part of the pouring tube 7 is preferably at least 5 cm, preferably at least 6 cm, for example in the range of 10-13 cm, corresponding to a typical depth of for example a wine glass, such that an exit opening 21 of the pouring tube 7 can be held in a cavity of the recipient 2, such as a wine glass, near a bottom, without the neck part extending in the cavity. The upper part 25 of the neck part 5 may be formed as a separate body separate from the lower part 24, but is preferably made out of one piece, or integral with, the lower part 24.

As shown in FIG. 7*a* and FIG. 7*b* the lower part 24 and upper part 25 of the neck part 5 are mutually coupled via a bridging part 26. The bridging part 26 may be a tube-like member defining part of a liquid channel 8, which liquid channel 8 extends from a liquid inlet opening 27 at a lower end of the lower part 24 of the neck part 5 through the lower part 24, bridging part 26 and upper part 25 to a liquid outlet opening 28 in the upper part 25 which outlet opening 28 is provided to be in open fluid connection with pouring tube 7 when pouring tube 7 is coupled to upper part 25. The outlet opening 28 of the liquid channel 8 may open into the space in the upper part 25 which is intended and adapted to in use receive the coupling part of the pouring tube 7 therein. A pouring channel defined by the pouring tube 7 may be dimensioned to fit over an end of the liquid channel 8 comprising the outlet opening 28, e.g. with the coupling part of the pouring tube being clampingly received in a space of the upper part 25 between an inner surface of the upper part 25 defining a cavity and an outer surface of the part of the liquid channel 8 comprising the outlet opening 28 extending in the cavity. The pouring aid device 1 may comprise droplet catcher means 33 provided between the pouring tube 7 and the neck part 5. For example, a capillary space 33 may be provided between the outer surface of the coupling part of the pouring tube 7 and the inner surface of the upper part 25 of the neck part 5 near the opening through which the pouring tube 7 extends. Closure means may be provided to partially or completely fit in the space of the upper part 25 to seal the outlet opening 28 when the pouring tube 7 is detached from the neck part 5. The bridging part 26 is provided to span a distance between an outer surface of the lower part 24 and an outer surface of the upper part 25. As shown in FIG. 7*a* and FIG. 7*b* the bridging part 26 is curved, with the lower part 24 and upper part 25 of the neck part 5 being angled with respect to each other. As such the outlet opening 28, or an exit opening 21 of the pouring tube 7, when coupled to the upper part 25, makes an angle with the inlet opening 27 comprised in a range of 130°-140°, and preferably around 135°. The bridging part 26 of the neck part 5 may, but not necessarily so, be substantially and/or entirely be made of a resilient material, such as for example silicon, or any other suitable material, or of a combination of materials to enable a deformation of the bridging part. A deformable bridging part allows for movement of the lower part 24 and/or upper part 25 with respect to each other to enable positioning of the parts with respect to each other as desired. The lower part 24, upper part 25 and bridging part 26 may be of one piece, or formed integral, as shown in FIG. 7*a* and FIG. 7*b*. By providing the upper part 25, the bridging part 26 and the lower part 24 as a single piece, also the liquid channel 8 is a single piece and liquid can thus flow through the neck part 5 without obstructions. The lower part 24, upper part 25 and bridging part 26 may for example be made of silicon. The lower part 24, upper part 25 and bridging part 26 may be molded, preferably as a single piece. By molding the lower part 24, upper part 25 and bridging part 26 as a single piece, the bridge part 26 can be made as a straight tube between the upper part 25 and the lower part 24 for ease of manufacturing. Then, in particular when the material is resilient, such as silicon, upon assembling the thus formed piece into shell parts 30, 31 of the housing, the bridge part 26 can be deformed to provide the angle between the upper part 25 and the lower part 24. The shell parts 30, 31 are of a more stiff material than the piece comprising the upper part 25, lower part 24 and bridge part 26 to deform, in particular, the bridge part 26 and the keep the bridge part 26 in this position.

The pouring aid device 1 may further comprise a housing extending at least around the bridging part 26 of the neck part 5. As shown in FIG. 7 the housing comprises two shell parts 30, 31 which can be coupled to each other to form the housing. As shown in FIGS. 7*a*, 7*b* the shell parts are each substantially formed by a curved wall, so that when the shell parts are coupled to each other a space is defined there between for receiving at least the bridging part 26 of the neck part 5 therein. The shell parts may be substantially mirrored parts. The shell parts are substantially form-retaining parts. They shell parts 30,31 may be made from or comprise a relatively strong and durable material, and in particular may be made out of or comprise a metal. The shell parts may alternatively be partially or completely deformable. The shell parts 30,31 may for example be made of a plastic or any other suitable material known to the person skilled in the art. As shown in FIGS. 7*a* and 7*b* the shell parts 30,31 extend partially over the lower part 24 and upper part 25 of the neck part 5. The shell parts 30,31 may fixate particularly a positioning of the lower part 24, upper part 25 and bridging part 26 of the neck part 5 with respect to each other. A cavity 14, or air chamber, is formed inside the space defined by the shell parts 30,31 around the bridging part 26 between the outer surface of the lower part 24 and the outer surface of the upper part 25. The air chamber 14 may be in open fluid communication with the outside, for example by an air opening provided in the housing and/or a fit of the housing around the neck part 5 not being fluid tight. Such open fluid communication between the air chamber 14 and the outside may optionally be closed, for example by providing closing means such as a cover element, to minimize an exchange of air in the container 3. The pouring aid device 1 further comprises an air tube 9 extending through an air channel 10 provided in the lower part 24 of the neck part 5. One open end of the air tube 9 opens in the air chamber in the pouring aid device 1 and an opposite open end of the air tube 9 is arranged to extend in use into the container 3 for letting air into and out of the container 3. The air channel 10 of the neck part 5 is separate from the liquid channel 8 to prevent liquid poured out of the container 3 in use from coming into contact with air entering the container 3.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage. Many variants will be apparent to the person skilled in the art. All variants are understood to be comprised within the scope of the invention defined in the following claims.

The invention claimed is:

1. A pouring aid device for pouring a liquid from a container into a recipient, comprising:

a neck part configured to fit on an opening of the container;

a pouring tube in fluid connection with a liquid channel of said neck part;

an air tube in fluid connection with an air channel of said neck part, wherein the air tube is configured to extend into the container in order to let air into and out of the container through the air channel;

wherein the air tube is configured to reach a bottom corner of the container such that during pouring of the liquid from the container through the liquid channel and pouring tube, the air tube extends into an air bell formed in the bottom corner of the container;

wherein an angle between an exit opening of the pouring tube and a center line of the neck part is in a range of 130°-140°;

wherein the air channel of the neck part is separate from the liquid channel to prevent the liquid being poured out of the container during use from coming into contact with air entering the container; and wherein the pouring aid device is adjustable between at least an open position in which liquid can exit the container through the pouring tube, and a storage position in which the pouring tube is closed off.

2. The pouring aid device according to claim 1, wherein the neck part is configured to receive the air tube at an angle of at least 5° with respect to a center line of the neck part.

3. The pouring aid device according to claim 1, wherein the neck part comprises a lower part defining a liquid inlet opening of the liquid channel, an upper part defining an outlet opening of the liquid channel and a bridging part between the lower part and upper part defining part of the liquid channel.

4. The pouring aid device according to claim 1, wherein the pouring tube is at least partly made of a flexible material such that the pouring tube includes at least one flexible area.

5. The pouring aid device according to claim 1, wherein the pouring tube is configured to be folded substantially along the neck part in the storing position of the pouring aid device.

6. The pouring aid device according to claim 1, comprising a closing element configured to close off the pouring tube, wherein said closing element is arranged outside the pouring tube.

7. The pouring aid device according to claim 6, wherein said closing element is configured to close off the pouring tube by squeezing the pouring tube in a flexible area.

8. Method of pouring liquid from a container into a recipient comprising the steps of:

fixing a pouring aid device on the container filled with liquid, wherein said pouring aid device is a pouring aid device according to claim 1;

tilting the container and inserting a pouring tube of the pouring aid device into a recipient such that said pouring tube reaches a bottom area of the recipient;

wherein the liquid is being poured into the recipient while the pouring tube is kept close to the bottom area of the recipient.

9. A method according to claim 8, further comprising a step of bringing the pouring aid device from a storage position, in which the pouring tube is closed off, to an open position of the pouring tube by pivoting the pouring tube from the storage position substantially along a neck part of the pouring aid device to the open position, in which an exit opening of the pouring tube makes an angle with a center line of the neck part comprised in a range of 130°-140°.

10. A method according to claim 8, further comprising a step of bringing the pouring aid device into a storage position in which the pouring aid device is closed off, wherein the pouring tube is closed off by squeezing the pouring tube.

11. A method according to claim 10, wherein the pouring tube is squeezed by folding the pouring tube substantially along a neck part of the pouring aid device.

12. The pouring aid device according to claim 1, further comprising a housing including a first housing part arranged to substantially enclose part of the neck part, wherein the housing comprises two coupled shell parts defining a space there between for receiving the part of the neck part therein.

13. The pouring aid device according to claim 12, wherein between the shell parts and the part of the neck part an air chamber is formed into which the air tube opens at one open end thereof.

14. The pouring aid device according to claim 13, wherein the air chamber is in open fluid communication with an outside air.

15. The pouring aid device according to claim 12, wherein the housing comprises a second housing part substantially enclosing the pouring tube.

16. The pouring aid device according to claim 15, wherein said first housing part is pivotably attached to said second housing part.

17. The pouring aid device according to claim 15, wherein said second housing part forms a handle configured to move the pouring tube between the open position and the storing position of the pouring aid device.

18. The pouring aid device according to claim 15, wherein said second housing part includes a closing element configured to press against an outside of the pouring tube for closing off said pouring tube in the storage position of the pouring aid device.

19. The pouring aid device according to claim 18, wherein said closing element is configured to close off the air tube in a storage position of the pouring aid device.

* * * * *